US008152541B2

(12) United States Patent
Sakiyama et al.

(10) Patent No.: US 8,152,541 B2
(45) Date of Patent: Apr. 10, 2012

(54) CARD CONNECTOR

(75) Inventors: Tomoyuki Sakiyama, Hamamatsu (JP); Kentaro Nakamura, Uji (JP); Naoki Yamachika, Yao (JP)

(73) Assignees: Nintendo Co., Ltd., Kyoto (JP); Hosiden Corporation, Osaka (JP)

( * ) Notice: Subject to any disclaimer, the term of this patent is extended or adjusted under 35 U.S.C. 154(b) by 117 days.

(21) Appl. No.: 12/473,727

(22) Filed: May 28, 2009

(65) Prior Publication Data

US 2009/0298321 A1 Dec. 3, 2009

(30) Foreign Application Priority Data

Jun. 2, 2008 (JP) ..... 2008-144713

(51) Int. Cl.
*H01R 24/00* (2006.01)

(52) U.S. Cl. ..... 439/138; 439/633

(58) Field of Classification Search ..... 439/677, 439/680, 681, 630, 633, 135–138
See application file for complete search history.

(56) References Cited

U.S. PATENT DOCUMENTS

| | | | | |
|---|---|---|---|---|
| 6,478,630 | B1 * | 11/2002 | Hsu | 439/680 |
| 6,764,323 | B2 * | 7/2004 | Shimada et al. | 439/681 |
| 2006/0046542 | A1 | 3/2006 | Obara et al. | |

FOREIGN PATENT DOCUMENTS

| | | | |
|---|---|---|---|
| JP | 2001-267013 | A | 9/2001 |
| JP | 2002-216905 | A | 8/2002 |
| JP | 2004-178903 | A | 6/2004 |
| JP | 2006-066310 | A | 3/2006 |

* cited by examiner

*Primary Examiner* — Felix O Figueroa
(74) *Attorney, Agent, or Firm* — The Webb Law Firm

(57) ABSTRACT

A card connector which effectively prevents erroneous insertion of a card having a width smaller than a specified width has an introducing space formed between a body having contacts and a cover. An insertion preventing wall is formed in the body facing the upstream side in the card inserting direction. The cover includes a restricting plate projecting toward the introducing space, with the restricting plate being under a posture projecting further toward the introducing space on the downstream side in the card inserting direction. The restricting plate forms, at widthwise opposed ends thereof, contacting pieces which are deformed as coming into contact with widthwise opposed ends of a card, thereby lifting up the restricting plate.

6 Claims, 7 Drawing Sheets

CARD CONNECTOR

TECHNICAL FIELD

The present invention relates to improvement of a card connector having an erroneous insertion preventing mechanism for preventing erroneous insertion of a card having a width smaller than a specified width.

BACKGROUND ART

Card connectors having the above-described constructions are known from e.g. Patent Document 1 and Patent Document 2, respectively. In Patent Document 1, an erroneous inserting preventing spring 21 is formed as a cutout raised piece at a widthwise center portion in a cover member 20 to be placed over a connector body 11. If a CF card under its longitudinal orientation is inserted into the connector body 11, the erroneous inserting preventing spring 21 comes into contact with the upper surface of this CF card and displaces the card from the card inserting plane, thereby to prevent the CF card from reaching a group of contacts 14.

In Patent Document 2, a shutter member 13 is supported to be pivotable about a transversely oriented axis at a position on the inner side of an opening 4 into which a card C1 is to be inserted. This shutter member 13 integrally forms a shutter portion 15 configured for preventing erroneous insertion of the card C1, the shutter portion 15 being spring-urged to maintain its closed posture. A pair of stopper members 20A, 20B are disposed on widthwise opposed ends of the shutter portion 15 and are pivotable about vertical axis. And, in these stopper members 20A, 20B, there are formed retaining portions 23A, 23B which contact the back surface of the shutter portion 15.

The stopper members 20A, 20B are maintained under postures for preventing pivotal movement of the shutter portion 15 by torsion springs 26A, 26B. If a card C1 of a specified width is inserted to the opening 4, opposed ends of this card C1 come into contact with contacting portions 22A, 22B of the stopper members 20A, 20B, thus pivoting the respective stopper members 20A, 20B, whereby the retaining portions 23A, 23B are moved away from the back face of the shutter portion 15. When this condition is realized, the shutter portion 15 is opened up by the force from the card C1 along the inserting direction, thus allowing insertion of this card C1.

Conversely, if an attempt is made to insert a card with a width smaller than the specified width, no pivotal movement of the stopper members 20A, 20B occurs, so that the shutter portion 15 is maintained under the closed posture, thus preventing erroneous insertion of this card.

[Patent Document 1] Japanese Patent Application "Kokai" No. 2002-216905 (paragraphs [0007-0011], FIGS. 1-3)

[Patent Document 2] Japanese Patent Application "Kokai" No. 2006-66310 paragraphs [0024-0039], FIGS. 1-9)

DISCLOSURE OF THE INVENTION

Problem to be Solved by Invention

In the case of Patent Document 1, as the erroneous insertion preventing spring constitutes an erroneous insertion preventing mechanism, erroneous card insertion is prevented by a simple construction. On the other hand, this erroneous insertion preventing spring comes into contact with the back face of the card even if this card is inserted under the appropriate posture. Hence, there was inconvenience of damage to a labeled surface of the card.

In the case of Patent Document 2, while erroneous card insertion can be effectively prevented, the construction is complicated and requires difficult and troublesome assembly. Moreover, in this Patent Document 2, when a card having the specified width is inserted, the shutter portion comes into contact with the surface of this card. Therefore, it is believed that there w111 occur the same inconvenience of possible damage to the labeled surface of the card, like Patent Document 1 construction described above.

In view of the recent situation using cards of varied sizes, it may be said that the erroneous insertion preventing mechanism for preventing erroneous insertion of cards having widths smaller than the specified width is a must for the card connector. On the other hand, it is desired that its construction should avoid giving any damage to the label of the card and also that the construction should be simple.

An object of the present invention is to provide an improved card connector which can effectively prevent erroneous insertion of a card having a width smaller than a specified width and which, at the same time, can avoid giving any damage to the labeled surface of an inserted card.

Means to Solve the Problem

According to the present invention, there is provided a card connector having an erroneous insertion preventing mechanism for preventing erroneous insertion of a card having a width smaller than a specified width, the card connector comprising:

a body including a plurality of contacts;

a main wall member disposed at a position opposed to said body across an introducing space for guiding the card to said contacts; and an insertion preventing wall provided at an upstream end in the card inserting direction at a base portion having said contacts;

wherein said erroneous insertion preventing mechanism includes a restricting plate having a widthwise center base end portion thereof provided in said main wall member and a leading end portion thereof protruding toward said introducing space, the leading end portion of the restricting plate being pivotally supported through elastic deformation, and said restricting plate forms, at widthwise opposed ends thereof, contacting pieces which are deformed as coming into contact with widthwise opposed ends of a card having a specified width inserted into said card connector, thereby pivoting the leading end portion of the restricting plate to a position away from said card.

With the above-described construction, when a card having a narrow width is erroneously inserted, this card comes into contact with the restricting plate, thus being sent in a direction departing from the main wall member to eventually come into contact with the insertion preventing wall, so that this card is prevented from reaching the portion of the contacts. On the other hand, when a card of the specified width is inserted, the widthwise opposed ends of this card come into contact with the contacting pieces of the restricting plate, so that in response to a displacing force from the contacting pieces, the leading end of the restricting plate is displaced in the direction away from the card. Accordingly, the inconvenience of the leading end of the restricting plate coming into contact with the surface of the card is avoided and at the same time, this card can be sent in along the introducing space. Therefore, an improved card connector which can effectively prevent erroneous insertion of a card having a width smaller than a specified width and which, at the same time, can avoid giving any damage to the labeled surface of an inserted card, has been realized with a simple and easy-to-manufacture construction.

Preferably, said main wall member comprises a cover connected to said body and said restricting plate comprises a slit formed in said cover, with a portion of the base end portion of the restricting plate supported to the cover and the leading end of the restricting plate cut away from the cover. With this construction, the restricting plate can be formed easily by forming a slit in the cover by e.g. a pressing operation, rather than providing a separate restricting plate.

Preferably, the base end portion of the restricting plate is curved to extend in the direction away from the surface of the card. If there occurs a change in the posture of the leading end of the restricting plate in the direction away from the cover, the base end portion of the restricting plate will protrude toward the card. The above construction can restrict this phenomenon and avoid contact between this base end portion and the card surface.

Still preferably, said each contacting piece forms a projecting portion projecting toward the introducing space and coming into contact with the corresponding widthwise end of the card having the specified width. With this construction, the restricting plate is significantly lifted up in response to contact of the card to the projecting portion, so that it is possible to avoid the inconvenience of contact of the leading end portion with the card surface.

BEST MODE OF EMBODYING THE INVENTION

Next, an embodiment of the present invention will be described with reference to the accompanying drawings.

[General; Construction]

As shown in FIGS. 1-5B, this card connector includes a body B having a plurality of contacts 1, a cover C as a "main wall member" for covering the body B, a slider S slidable relative to the body B in the card inserting direction between an ejecting position (Ej) and a locking position (Lo) (see FIGS. 3A, 3B and 4A, 4B), and a locking mechanism L for retaining/locking the slider S at the locking position (Lo). Further, in the cover C, there is provided a restricting plate R acting as an "erroneous insertion preventing mechanism" for preventing erroneous insertion of a card M having a width smaller than a specified width (excluding the specified width per se).

This card connector is to be provided in an instrument such as a digital camera, a mobile phone, a PDA, etc. The card connector realizes mounting and dismounting of cards M of various sizes, such as "Smart Media" (registered trademark), "Memory Stick"®, as the flash type memory media, or an "SD card"®, or a "Micro Drive"® as a compact hard disc device, relative to the instrument.

This card connector can be used under any desired posture. In the following discussion, the card connector is used under the posture shown in FIG. 1, with the body B being on the lower side and the cover C being on the upper side. In accordance with this, as shown in FIGS. 2A-2F, in the following discussion, the face of the card M having a label affixed thereto will be referred to as the upper face, and the opposite face mounting a plurality of electrodes will be referred to as the lower face, respectively.

The body B includes integrally a base portion 2 provided as a molded article made of an electrically insulating resin and carrying a plurality of contacts 1, a pair of side wall portions 3 provided at the opposed ends in the width direction of the card M and vertically extending and a bottom wall portion 4 under horizontal posture and extending continuously from the pair of side wall portions 3 and the base portion 2 on the lower sides thereof. Further, a support block 5 is formed at an inner side portion of one of the pair of side wall portions 3. And, to this support block 5, there is supported a slider S to be slidable along the inserting direction of the card M. More particularly, at the upstream end of the base portion 2 relative to the card inserting direction, there is formed an insertion preventing wall 2S disposed to extend normal to the card inserting direction. The contacts 1 are formed of a conductive metal such as copper alloy.

The cover C is a press-molded article made of a metal material which can be relatively easily worked and has an appropriate degree of rigidness and elastic deformation, such as a thin plate of aluminum alloy, steel alloy, etc. This cover C includes a cover body 10 disposed in opposition to the body B across an introducing space T and side wall members 11 disposed at positions for covering the outer surfaces of the side walls 3 of the body B.

The side wall member 11 defines a plurality of retaining holes 11A for engaging and receiving a retaining piece 3A formed as a projection on the outer surface of the side wall portion 3 of the body B. The cover body 10 forms the restricting plate R (to be detailed later) having a portion of its base end portion extending continuously from the cover body 10 and its leading end portion cut away from the cover body 10, due to presence of a slit 10B, and forms also a pressing plate 13 in the form of a tongue-like piece formed as being cut from the body due to the presence of the slit with leaving a portion of the piece left un-cut therefrom, so that the pressing plate 13 applies an urging force to a pin 25 to be inserted into a cam groove 23 (see FIGS. 3A, 3B and 4A, 4B) in its pressing direction.

The "proper" card M to be inserted into this card connector has a specified width as shown in FIGS. 2A-2F and has a label ML affixed to its upper face MT, and at the leading end portion of its lower face MB relative to the inserting direction, there are provided a plurality of electrodes P disposed in juxtaposition to come into contact with the contacts 1 and establish electrical communication therewith. Incidentally, these electrodes P are mounted on a supporting face which is displaced slightly upward from the lower face MB, and a level difference between this supporting face and the lower face MB is set to have a value equal to a level difference between the bottom wall portion 4 and the upper end of the insertion preventing wall 2S.

Further, on the lower face side of one widthwise end, a concave portion (Mx) is formed and at a corner of the leading end in the inserting direction, there is formed a cutout portion (My) for preventing insertion under erroneous posture.

[Slider and Locking Mechanism]

As shown in FIGS. 3A, 3B and FIGS. 4A, 4B, the slider S includes a slider body 20 made of a resin material, a contacting portion 21 projecting into the body to come into contact with the cutout portion (My) of the card M, and an engaging member 22 formed of a spring material for engaging into the concave portion (Mx) of the side face of the card M. Further, the slider body 20 is supported to be slidable relative to a groove-like guide portion formed in the support block 5 of the body B, and in the upper face of the slider body 20, there is formed the cam groove 23 having a heart cam construction.

Further, between the slider body 20 and the base portion of the body B, there is provided a compression coil spring 24. This compression coil spring 24 urges the slider body 20 toward the ejecting position (Ej). Further, a pin 25 is disposed between and across a hole portion 5A at the upstream portion of the support block 5 in the card inserting direction and the cam groove 23.

This pin 25 is a member having a one lateral end opened rectangular shape formed of a piano wire and is disposed with one end thereof inserted into the hole portion 5A and the other end thereof inserted into the cam groove 23. This pin 25 is prevented from floating up from the cam groove 23, as the pressing plate 13 formed like a tongue-like piece in the cover C comes into contact therewith from above.

And, if the proper card M is inserted, the slider body 20 is moved together with this card M, against the urging force of the compression coil spring 24. Upon release of the inserting force after arrival of the card M at the insertion end, the terminal end of the pin 25 reaches the locking position of the cam groove 23, so that, as shown in FIG. 4, the pin 25 prevents movement to the ejecting position (EJ) of the slider body 20 and retains this at the locking position (Lo). At this locking position (Lo), the plurality of electrodes P of the card M contact the plurality of contacts 1 of the body B, whereby electric communication is established therebetween.

Thereafter, when the card M is pressed in the inserting direction, the terminal end of the pin 25 departs from the locking position, and as shown in FIG. 3, under the urging force of the compression coil spring 24, the slider body 20 is moved together with the card M to the ejecting position (Ej), thus realizing withdrawal of the card M.

As described above, the locking mechanism L comprised of the heart cam type cam groove 23 and the pin 25 described above belongs to the well-known technique as shown in e.g. Japanese Patent Application "Kokai" No. 2001-267013 and Japanese Patent Application "Kokai" No. 2004-178903. Therefore, detailed explanation of the construction of the cam groove 23 and the operational modes of the pin 25 for the locking operation and unlocking operations will be omitted.

[Restricting Plate]

The restricting plate R integrally includes a base end portion 14 on the upstream side in the card inserting direction, a leading end portion 15 on the downstream side in the card inserting direction and a pair of contacting pieces 16 which come into contact with the widthwise opposed ends of the card M having the specified width, thus being displaced upwardly as the result of this contact. Further, due to designing of the shape of the slit 10S, the restricting plate R contacts the cover body 10 through connecting portions 17 provided at two positions across the base end portion 14.

The leading end portion 15 of the restricting plate R is formed with an oblique posture extending toward the bottom wall portion 4. Further, the base end portion 14 is curved to extend away from the surface of the card, thus forming a curved face 14S.

The contacting piece 16 is disposed at an intermediate position in the card inserting direction between the base end portion 14 and the leading end portion 15, and in the lower face thereof, there is formed a projecting portion 16A projecting in the direction of the introducing space T (downward direction) to come into contact with the upper face of the card M at its opposed ends. This projecting portion 16A is formed by pressing operation. When the projecting portions 16A come into contact with the upper face of the card M at its opposed ends, this applies a force to the restricting plate R, which force lifts up the leading end portion 15 of this restricting plate R. In this, as shown in FIG. 5, as the connecting portions 17 are elastically deformed, the contacting pieces 16 are elastically deformed simultaneously, whereby this restricting plate R as a whole is pivoted away from the upper face of the card M.

In particular, when the leading end portion 15 of the restricting plate R is pivoted upward by the elastic deformation, the base end portion 14 moves slightly to the upper side of the card M. The curved faces 14S is formed with the curve so as to avoid contact between the end of the base end portion 14 and the upper face of the card M under this condition.

FIGS. 6A, 6B and 7A, 7B show conditions when a card (m) having a smaller width than the specified width is inserted into the card connector. As the leading end portion 15 of the restricting plate R is disposed inside the introducing space T, the leading end of the card (m) comes into contact with the restricting plate R, thus being guided toward the bottom wall portion 4, so that the leading end of this card (m) reaches a position contacting the insertion preventing wall 2S, thus being unable to be inserted any farther. This prevents the small-width card (m) from erroneously reaching the position to come into contact with the contacts 1.

[Insertion/Removal of Card]

According to the above-described construction, when the proper card M is inserted into the introducing space T with the slider S being located at the ejecting position (Ej), first, the engaging members 22 of the slider body 20 come into engagement with the concave portion (Mx) of the card M, thus preventing inadvertent removal of the card M. As the inserting operation is continued, the card M and the slider S are moved together in the inserting direction, with the portion of the cutout portion (My) of the card M being in contact with the contacting portion 21 of the slider body 20.

When the card M is inserted into the introducing space T as described above, the projecting portions 16A of the contacting pieces 16 of the restricting plate R come into contact with the upper face of the card M at its widthwise opposed ends, thereby to pivot upward the leading end portion 15 of the restricting plate R. In this, as the leading end portion 15 of the restricting plate R is lifted up to the position away from the upper face of the card M, it is possible to restrict the inconvenience of the leading end portion 15 of the restricting plate R coming into contact with the labeled face of the card M, thereby damaging this labeled face.

When the leading end portion 15 of the restricting plate R is pivoted upward as above, the base end portion 14 of the same is displaced slightly downward. Therefore, although this base end portion 14 is moved downward to be slightly closer to the upper side of the card M, thanks to the formation of the curved face 14S at the terminal end of the base end portion 14, it is possible to avoid the inconvenience of this base end portion 14 coming into contact with the upper face of the card M.

Further, after the pressing operation of the slider S to the movable limit, upon release of this pressing force, the position of the pin 25 relative to the heart-cam type cam groove 23 constituting the locking mechanism as described above reaches a position for preventing further movement of the slider S (i.e. the locking mechanism L is rendered into the locking state), so that the card M together with the slider body 20 is retained at the locking position (Lo).

Next, as the card M is manipulated again in the pressing direction, the position of the pin 25 relative to the heart-cam type cam groove 23 reaches a position allowing movement of the slider S (i.e. the locking state of the locking mechanism L is released), so that the card M together with the slider body 20 is pushed out under the urging force of the compression coil spring 24 to the ejecting position (Ej). whereby the card M can now be drawn out.

Further, in case the narrow card (m) having a width smaller than the specified width is inserted, as described above, the leading end of this card (m) comes into contact with the restricting plate R to be guided toward the bottom wall portion 4, so that the leading end of this card (m) reaches the position contacting the insertion preventing wall 2S, so as not be inserted. With this, there occurs no erroneous insertion of this narrow card (m) to the position contacting the contacts 1.

DESCRIPTION OF REFERENCE MARKS

Figure 1:
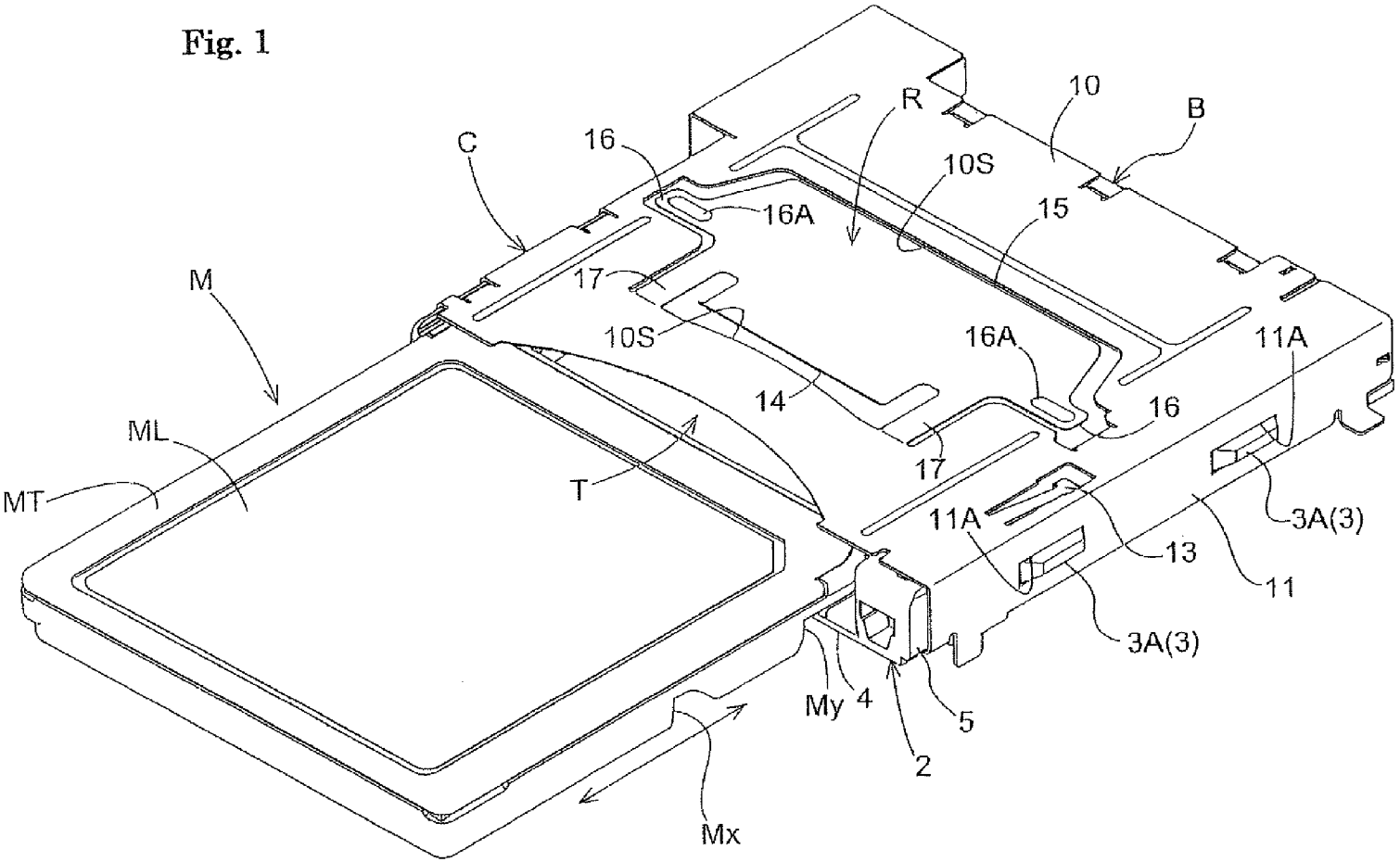
FIG. 1 is a perspective view showing a card connector and a card.
Figure 2A:
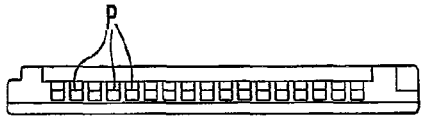
FIGS. 2A-2F are plan views showing the shape of the card.
Figure 2C:
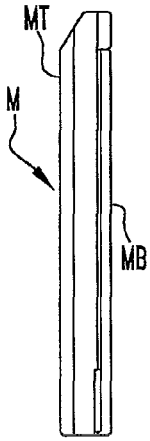
Figure 2B:
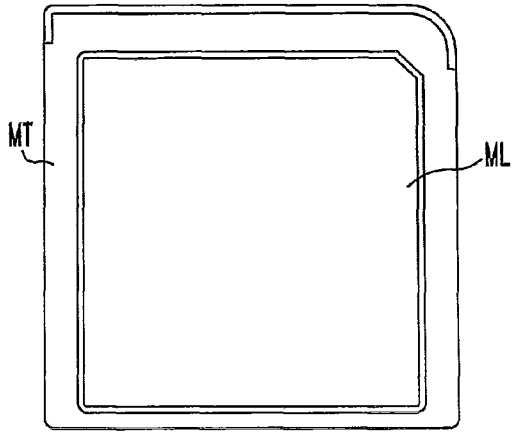
Figure 2D:
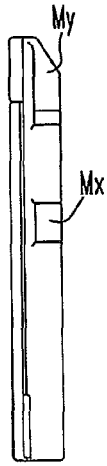
Figure 2E:
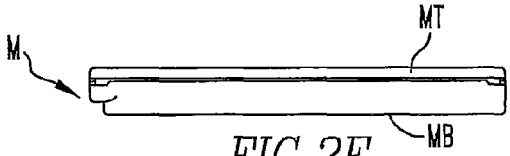
Figure 2F:
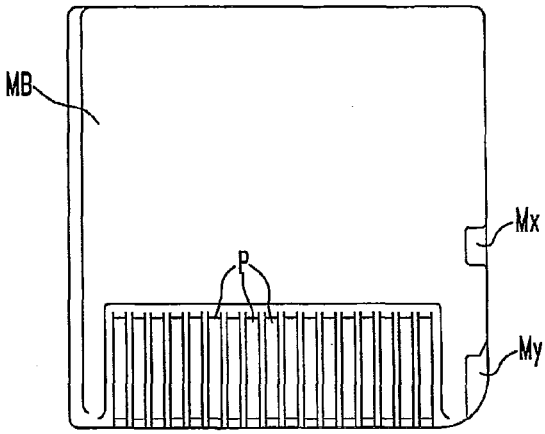
Figure 3A:
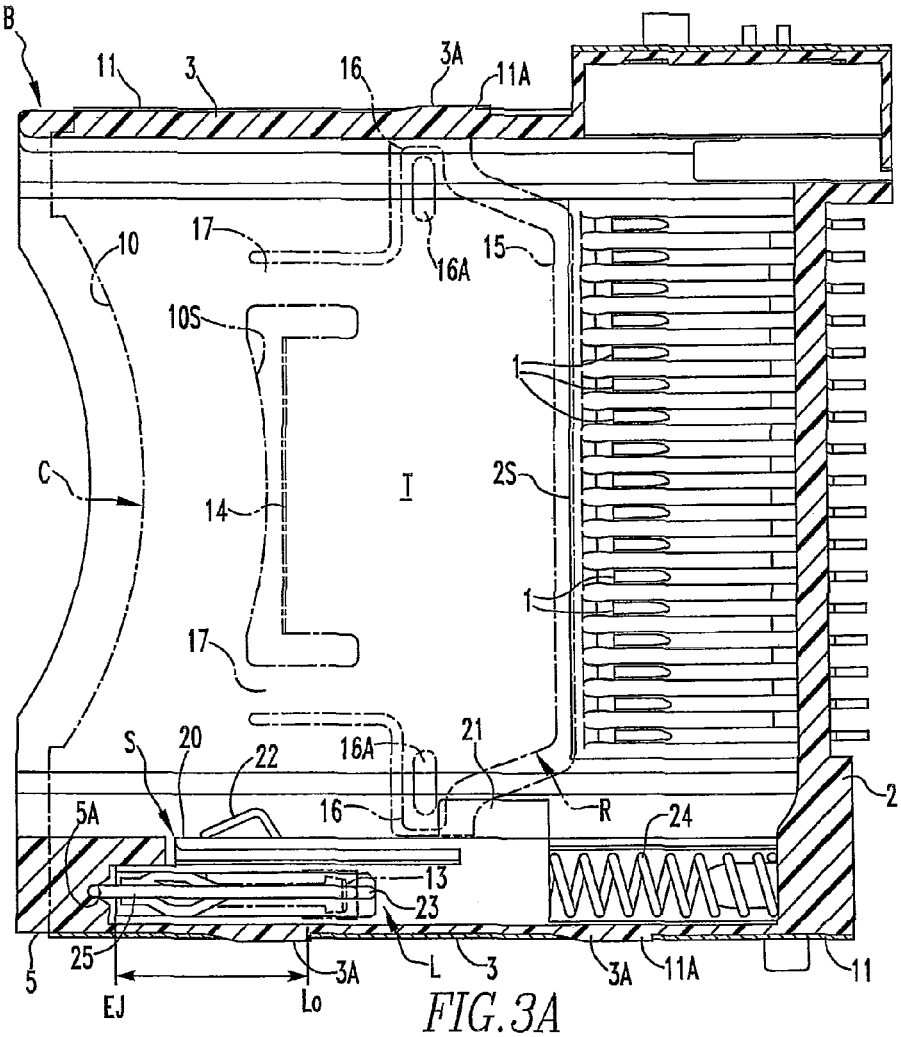
FIG. 3A shows a top cross-sectional view of the card connector with the card inserted therein.
Figure 3B:
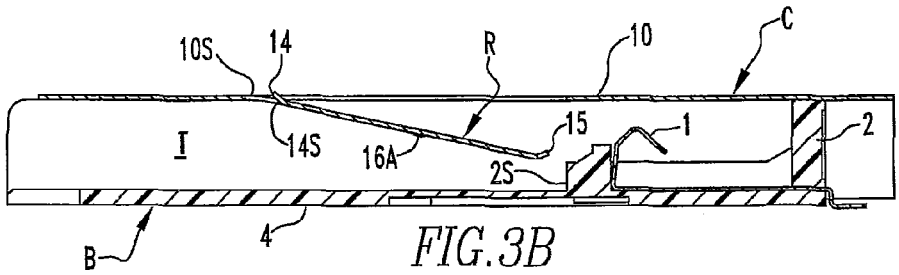
FIG. 3B shows a side cross-sectional view of the card connector showing a restricting plate.
Figure 4A:
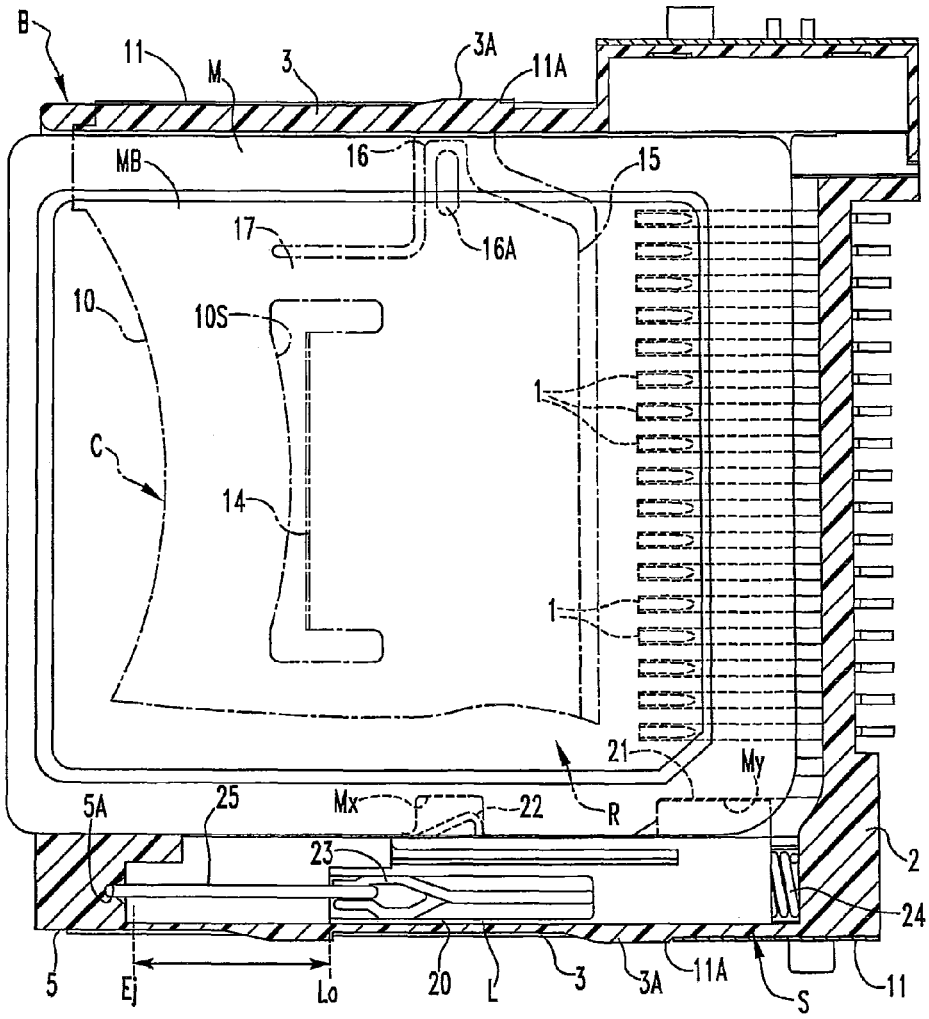
FIG. 4A is a top cross-sectional view showing the card connector with the card inserted therein.
Figure 4B:
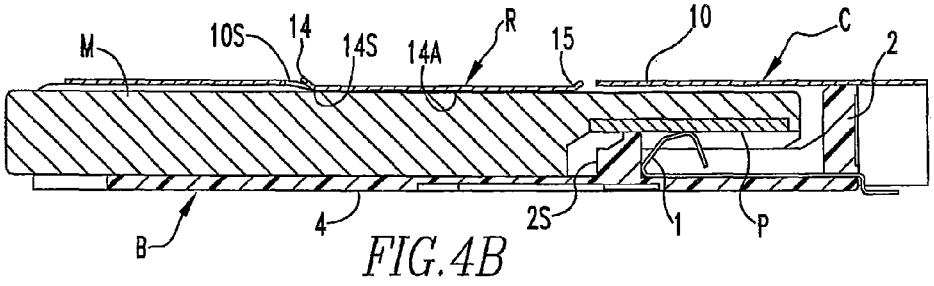
FIG. 4B is a side cross-sectional view showing the card connector with the card inserted therein.
Figure 5A:
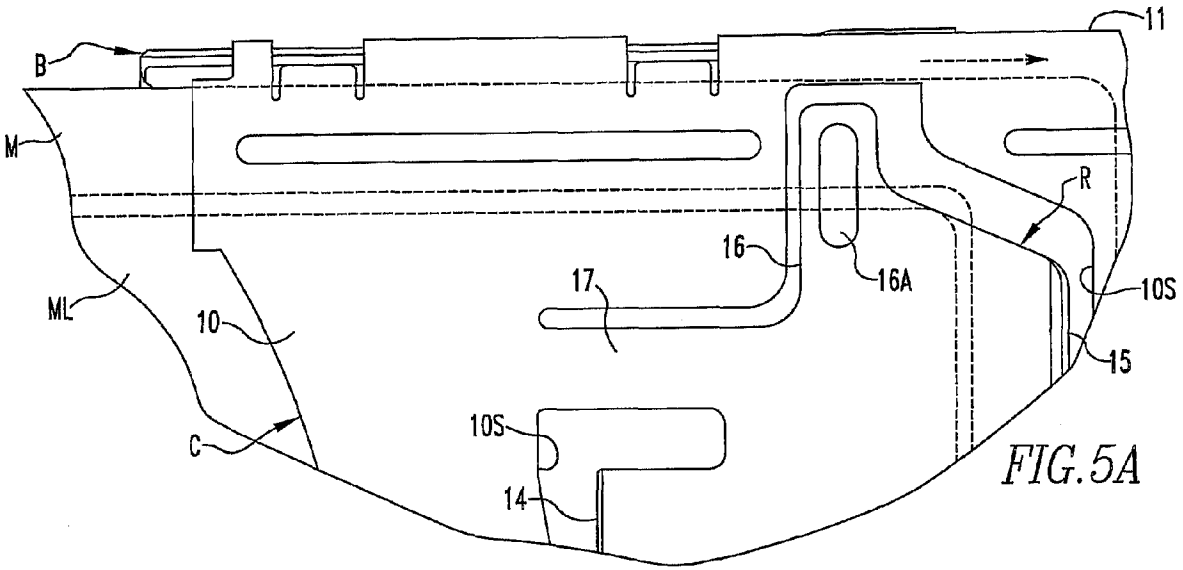
FIG. 5A is a detailed view of the contacting pieces of the restricting plate in the course of card insertion.
Figure 5B:
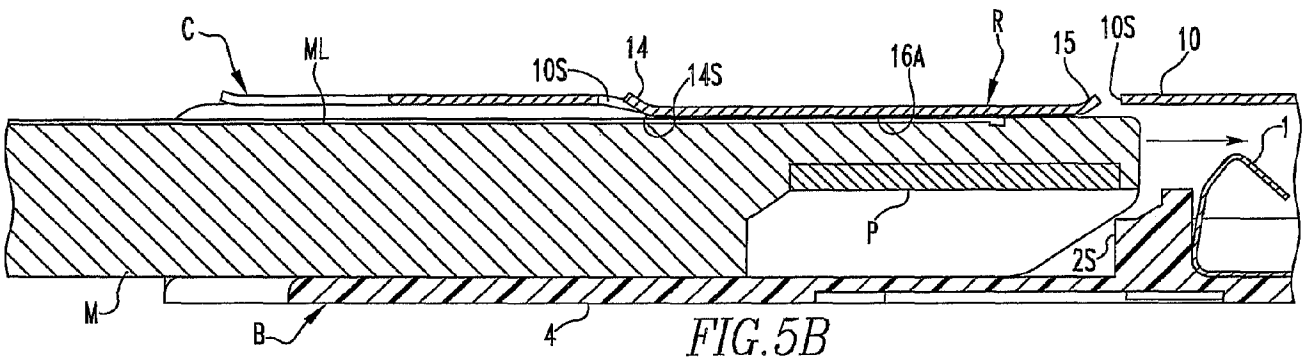
FIG. 5B is a side cross-sectional view of the restricting plate in the course of card insertion.
Figure 6A:
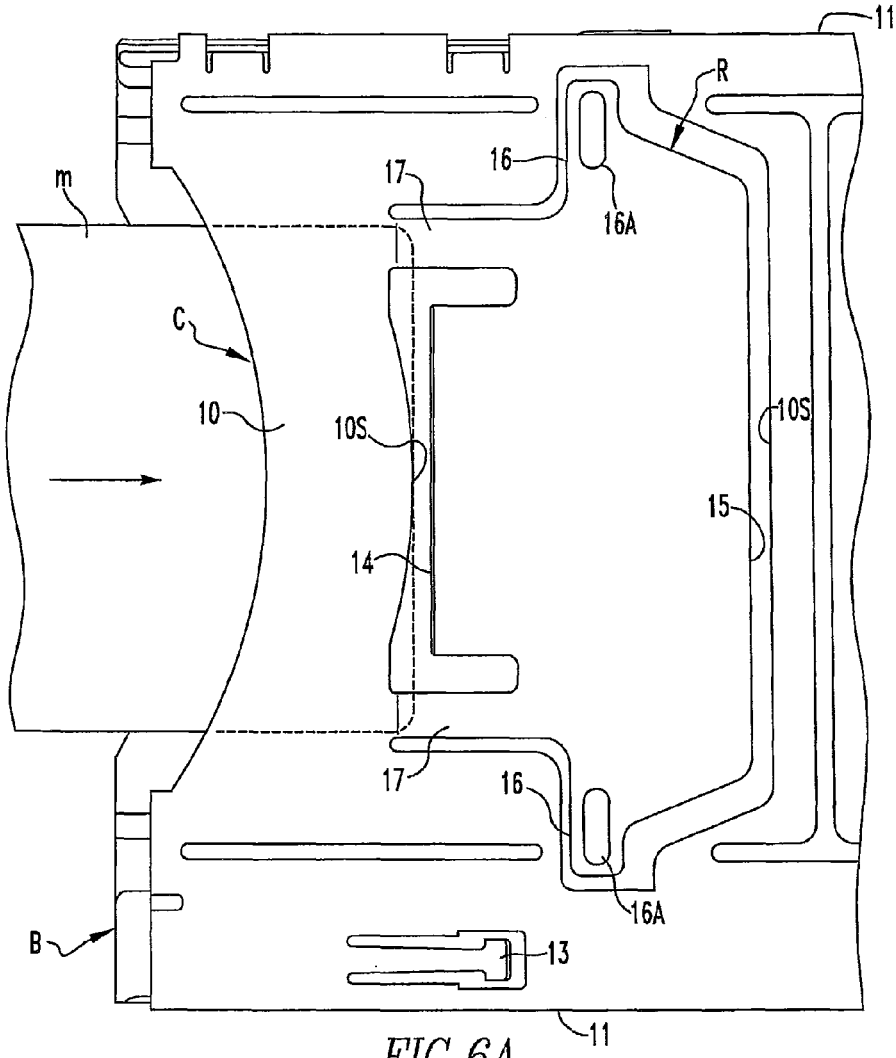
FIG. 6A is a detailed view of the restricting plate in the course of insertion of a card having a width smaller than the specified width.
Figure 6B:
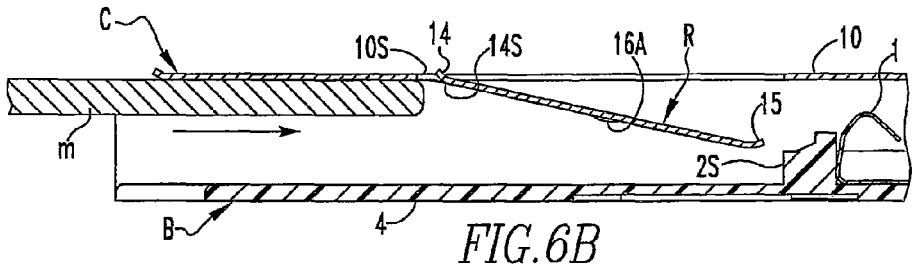
FIG. 6B is a side cross-sectional view of the restricting plate in the course of insertion of a card having a width smaller than the specified width.
Figure 7A:
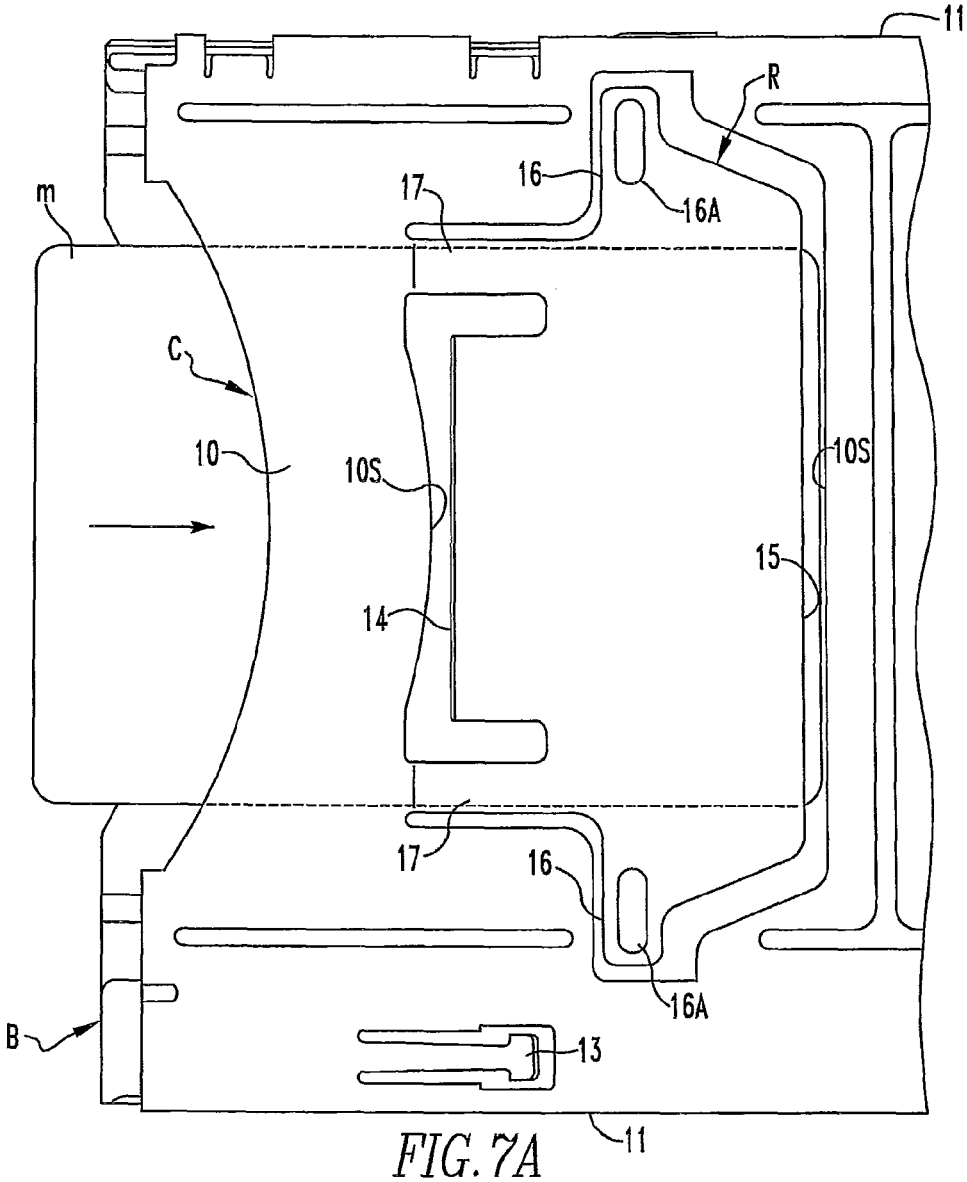
FIG. 7A is a top plan view of a portion of the restricting plate after the insertion of the card having a width smaller than the specified width.
Figure 7B:
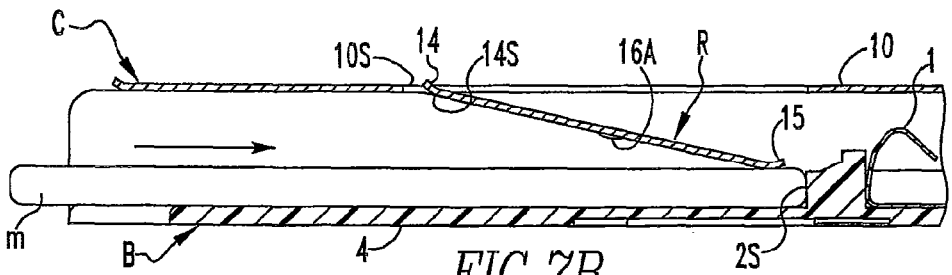
FIG. 7B is a side cross-sectional view of a portion of the restricting plate after the insertion of the card having a width smaller than the specified width.

1 contacts
2 base portion
2S insertion preventing wall
10S slit
14 base end portion
15 leading end portion
16 contacting piece
16A projecting portion
B body
C main wall member/cover
M card
R erroneous insertion preventing mechanism/restricting plate,
T introducing space

The invention claimed is:

1. A card connector having an erroneous insertion preventing mechanism for preventing erroneous insertion of a card having a width smaller than a specified width, the card connector comprising:

a body including a plurality of contacts arranged in a width direction which is perpendicular to an inserting direction and parallel to a major plane of an inserted card;

a main wall member disposed at a position opposed to said body across an introducing space for guiding the card to said contacts; and an insertion preventing wall provided on an introducing space side on a bottom wall portion continuous with a base portion having said contacts and on an upstream side in the inserting direction relative to said contacts, said insertion preventing wall being formed monolithically with said bottom wall portion and extending in the width direction and substantially across a range in which the contacts are arranged;

wherein said erroneous insertion preventing mechanism includes a restricting plate having a base end portion thereof at a center in the width direction, provided in said main wall member and a leading end portion thereof protruding toward said introducing space, the leading end portion of the restricting plate being pivotally supported through elastic deformation, said restricting plate forms, at opposed ends thereof in a direction parallel to the base end portion, contacting pieces which are deformed as coming into contact with opposed ends of a card in the width direction, which card has a specified width inserted into said card connector, thereby pivoting the leading end portion of the restricting plate to a position away from said card, and an plane extending in the inserting direction from the restricting plate crosses the insertion preventing wall.

2. The card connector according to claim 1, wherein said main wall member comprises a cover connected to said body and said restricting plate comprises a slit formed in said cover, with a portion of the base end portion of the restricting plate supported to the cover and the leading end of the restricting plate cut away from the cover.

3. The card connector according to claim 2, wherein the base end portion of the restricting plate is curved to extend in the direction away from the surface of the card.

4. The card connector according to claim 1, wherein said each contacting piece forms a projecting portion projecting toward the introducing space and coming into contact with the corresponding widthwise end of the card having the specified width.

5. The card connector according to claim 2, wherein said each contacting piece forms a projecting portion projecting toward the introducing space and coming into contact with the corresponding widthwise end of the card having the specified width.

6. The card connector according to claim 3, wherein said each contacting piece forms a projecting portion projecting toward the introducing space and coming into contact with the corresponding widthwise end of the card having the specified width.

* * * * *

UNITED STATES PATENT AND TRADEMARK OFFICE

CERTIFICATE OF CORRECTION

PATENT NO. : 8,152,541 B2
APPLICATION NO. : 12/473727
DATED : April 10, 2012
INVENTOR(S) : Tomoyuki Sakiyama et al.

It is certified that error appears in the above-identified patent and that said Letters Patent is hereby corrected as shown below:

Column 8, Line 28, Claim 1, delete “an plane” and insert -- a plane --

Signed and Sealed this
Twenty-fourth Day of July, 2012

David J. Kappos

David J. Kappos
*Director of the United States Patent and Trademark Office*